United States Patent [19]

Fenton

[11] Patent Number: 4,519,756

[45] Date of Patent: May 28, 1985

[54] CONSTANT DISPLACEMENT TURBINE WITH VANE WHICH PIVOTS AND ROTATES

[76] Inventor: John W. Fenton, 26 Shoreland Dr. - Angler's Park Shores, Key Largo, Fla. 33037

[21] Appl. No.: 537,934

[22] Filed: Sep. 30, 1983

[51] Int. Cl.[3] ..... F01C 3/06

[52] U.S. Cl. ..... 418/68

[58] Field of Search ..... 418/68, 195

[56] References Cited

U.S. PATENT DOCUMENTS

| | | | |
|---|---|---|---|
| 168,034 | 9/1875 | Lyon | 418/68 |
| 826,985 | 7/1906 | Appel | 418/68 |
| 1,952,260 | 3/1934 | Kempthorne | 418/68 |
| 2,040,178 | 5/1936 | Kempthorne | 418/68 |
| 3,184,154 | 5/1965 | May et al. | 418/68 |

FOREIGN PATENT DOCUMENTS

| | | | |
|---|---|---|---|
| 2038809 | 3/1972 | Fed. Rep. of Germany | 418/68 |
| 2309860 | 9/1974 | Fed. Rep. of Germany | 418/68 |
| 909309 | 2/1982 | U.S.S.R. | 418/68 |

*Primary Examiner*—John J. Vrablik

*Attorney, Agent, or Firm*—Dunlap & Codding

[57] ABSTRACT

A turbine comprising a housing and a vane assembly rotatably mounted in the housing for rotation about the axis of a ring forming a portion of the vane assembly. Vanes are mounted on the ring to pivot about diameters of the ring and sealing surfaces are formed on the vanes to mate with the inner surface of the housing and thereby divide the interior of the housing into an inlet chamber and an outlet chamber. The chambers move about the ring axis as the ring rotates and expand and contract with pivotation of the vanes on the ring. Drive shafts pivotally attached to the vanes extend through the housing wall so that rotation of the vane assembly will cause rotation of the drive shafts. The drive shafts further relate the vane assembly rotation to pivotation of the vanes on the ring so that pivotation of the vanes caused by pressurizing the inlet chamber while exhausting the outlet chamber will rotate the vane assembly and drive shafts. Ports formed through the housing wall and slots formed through the ring wall to provide fluid communication to the inlet and outlet chambers are positioned to cause a reversal between the inlet and outlet chambers for a selected position of the vane assembly in the housing so that the vane assembly will always rotate in the same direction.

21 Claims, 23 Drawing Figures

CONSTANT DISPLACEMENT TURBINE WITH VANE WHICH PIVOTS AND ROTATES

BACKGROUND OF THE INVENTION

1. Field of the Invention

The present invention relates generally to improvements in turbine construction and, more particularly, but not by way of limitation, to turbines used for providing a source of motive power.

2. Brief Description of the Prior Art

As sources of motive power, turbines offer several distinct advantages over piston engines. For example, where both the turbine and the piston engine are designed to be operated by the internal combustion of a fuel, the turbine is much less sensitive to the type of fuel that might be used. In general, a turbine can be easily adapted to use substantially any type of fuel; for example, a turbine can be easily operated using powdered coal. The piston engine, on the other hand, can be adapted to use such fuels as powdered coal only with difficulty and, because of the difficulty involved, only at relatively high expense.

In addition, the turbine generally operates at a higher efficiency than can a piston engine. A major factor causing reduced efficiency for a piston engine is that the pistons are brought to rest at the end of each stroke within the cylinders in which the pistons are disposed so that energy must be expended to start the piston moving again, in the opposite direction, as each new stroke is commenced. This energy is derived from the fuel being used to operate the engine so that the overall efficiency of the engine is lowered by the necessity of its expenditure. In the turbine, the vanes that the combusting fuel works against to turn the turbine shaft upon which the vanes are mounted are always moving in the same direction so that this efficiency decrease factor of the piston engine is avoided in the turbine engine.

While the loss of efficiency caused by the reciprocating motion of the pistons of a piston engine can be avoided by causing the piston to move continuously in one direction; for example, by adopting a design such as that found in the Wankel engine, such solution gives rise to yet another problem that results in a lowering of the efficiency of the engine. In engines of the Wankel type, the spaces inside the engine in which the fuel is burned have a relatively low volume to surface area ratio which results in large losses of heat through the walls of the engine. A resulting cooling of the combustion gases by conduction rather than adiabatic expansion of the gases gives rise to a lowering of the efficiency of the engine. That is, the increase in efficiency resulting from the continuous rotation of the piston in one direction is offset by a decrease in efficiency stemming from the geometry of the engine necessary to cause the engine to operate with the piston moving in one direction. The turbine engine, on the other hand, can easily be constructed to have a much larger volume to surface area ratio to eliminate this problem with the Wankel engine.

Despite the advantages of the turbine engine over the piston engine, there are applications in which the turbine engine has not been extensively used with an example of such an application being the use of a turbine as the prime mover of an automotive vehicle. While some turbine powered automobiles and trucks have been built, such vehicles are not in widespread use. This limitation on the use of the turbine stems from a basic characteristic of turbine engines. Because of the lack of closed combustion chambers in a turbine, turbine engines produce low torque when operated at low speed. The present invention overcomes this problem by providing a turbine with the constant displacement characteristics of the piston engine while avoiding the problems that reduce the efficiency of such engines and, at the same time, retaining the capability of the turbine engine to be operated using a variety of fuels including powdered, lowgrade coal.

SUMMARY OF THE INVENTION

The turbine of the present invention is comprised of a housing having one or two lobes positioned about a lobe axis extending through the housing. Each lobe has an inner surface that is shaped to conform to a portion of a spherical surface centered at a lobe center on the lobe axis and the turbine includes a vane assembly that is mounted in the housing to rotate about the lobe axis. The vane assembly includes one vane for each lobe of the housing and such vane is mounted on remaining portions of the vane assembly to pivot on such portions while simultaneously rotating about the lobe axis. A sealing surface is formed in an arc between the ends of the vane, to mate with the inner surface of the lobe with which the vane is associated, and means are provided to block fluid communication between the sides of the vane positioned about the sealing surface so that the vane, or vanes, divide the interior of the housing into two chambers, an inlet chamber and an outlet chamber. A drive shaft is pivotally connected to each vane to pivot about an axis perpendicular to the vane pivotation axis at the lobe center and passes through an aperture in the housing along a radius of the lobe, associated with the vane to which the drive shaft is attached, that is disposed at an angle to the lobe axis. The drive shaft thus provides a constraint on the movement of the vane within the housing and such constraint coordinates the pivotation of the vane with the rotation of the vane assembly such that, for each half rotation of the vane assembly, one chamber formed by the vane and disposed generally to one side of the housing must expand while the other chamber contracts. Porting to these chambers is positioned to feed gas into the chamber nearest one side of the housing while exhausting the chamber nearest the opposite side of the housing so that burning fuel introduced into one side of the housing, to force an expansion of the chamber such fuel enters; that is, the inlet chamber, will cause the vane assembly to rotate continuously in one direction. The rotation of the vane assembly is translated into a rotation of the drive shaft, or shafts, via the connection of each drive shaft to a vane as described above.

The continuous movement of the vanes thus eliminates the cause of low efficiency of piston engines of the reciprocating piston type that has been noted above and, at the same time, the nearly spherical shape of the turbine resulting from the shaping of the lobes and the mating of the vanes to this shape eliminates the efficiency losses associated with excessive heat conduction through the walls of the engine. On the other hand, the closure of the inlet and outlet chambers of the turbine by the mating of the vanes with the lobe inner surfaces eliminates the low torque at low speed characteristic that has been a problem with conventional turbines.

Thus, an important object of the present invention is to provide a turbine engine that combines the advantages of piston engines with the advantages of turbines while avoiding the disadvantages of either type of engine.

Another object of the invention is to provide a turbine which suffers substantially no loss of torque when operated at low speed.

A further object of the invention is to provide an engine capable of providing high torque at low speed operation from a variety of fuels including such fuels as powdered coal.

Other objects, advantages and features of the present invention will become clear from the following detailed description of preferred embodiments of the invention when read in conjunction with the drawings and appended claims.

BRIEF DESCRIPTION OF THE DRAWINGS

FIG. 19 corresponds to FIGS. 11 and 12 and FIG. 20 corresponds to FIGS. 17 and 18.

DESCRIPTION OF FIGS. 1–20

Figure 1:
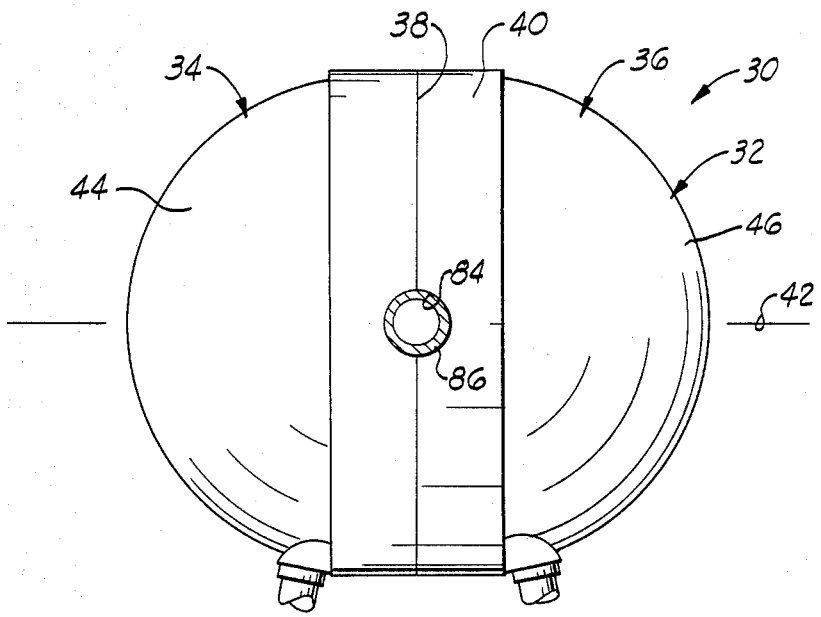
FIG. 1 is a plan view of a turbine constructed in accordance with the present invention.
Figure 2:
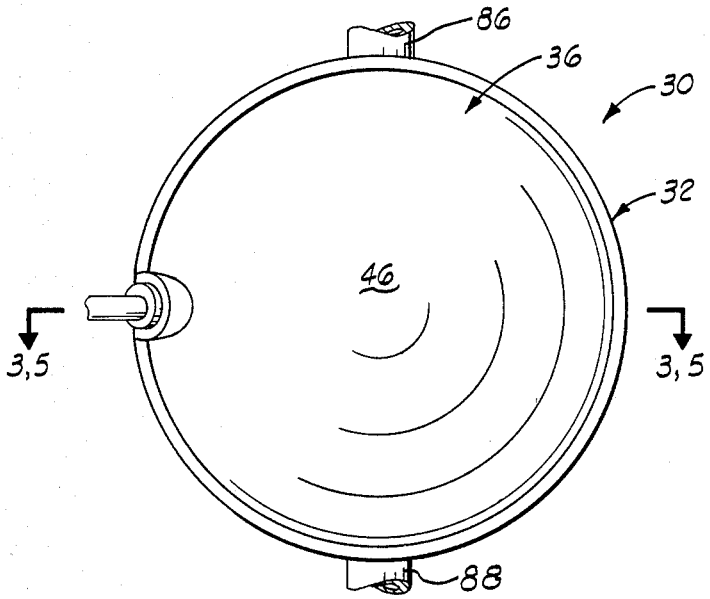
FIG. 2 is a side elevational view of the turbine of FIG. 1.

Referring now to the drawings in general and to FIGS. 1 through 4 in particular, shown therein and designated by the general reference numeral 30 is one preferred embodiment of a turbine constructed in accordance with the present invention. As shown in these Figures, the turbine 30 generally comprises a housing 32 which, to facilitate assembly of the turbine 30, can be constructed in two identical housing halves 34 and 36 which are secured together by any suitable means along a center line 38 of the housing 32. For example, suitable lugs, not shown can be provided on the housing halves 34, 36 so that the housing halves can be bolted together along the center line 38.

In general form, the housing 32 comprises a tubular housing center portion 40, comprised of ring-shaped portions of the housing halves 34, 36, the housing center portion 40 extending circularly about an axis 42 indicated in FIG. 1. For purposes that will become clear below, the axis 42 will be referred to herein as the lobe axis 42.

Figure 3:
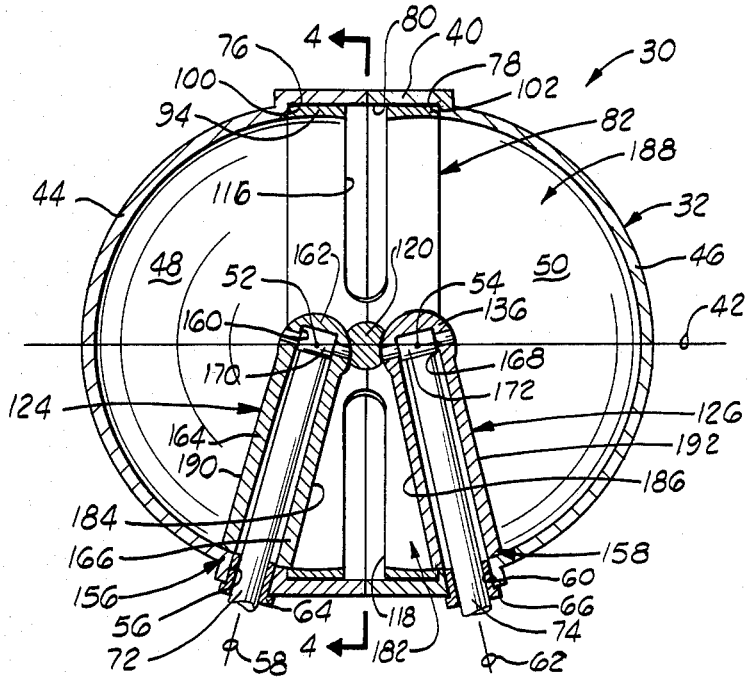
FIG. 3 is a cross section of the turbine of FIG. 1 taken along a plane including the drive shaft and lobe axes for one position of the vane assembly in the turbine casing.

To one side of the housing center portion 40, shown on the left in FIG. 1, the housing 32 has a first lobe 44 which can be formed integrally with the ring-shaped portion of the housing half 34 that forms a part of the housing center portion 40. Similarly, the housing 32 comprises a second lobe 46, similarly constructed as part of the housing half 36, disposed to the other side of the housing center portion 40. As shown in FIG. 3, the lobes 44, 46 are partially spherical shells, each of which has a lobe inner surface that is shaped to conform to a portion of a spherical surface, the lobe 44 having a lobe inner surface 48 and the lobe 46 having a lobe inner surface 50. Each of the lobe inner surfaces 48, 50 is disposed symmetrically about the lobe axis 42 and each is centered on a lobe center that is disposed within the housing center portion 40. The lobe centers have been marked in FIG. 3 and designated by the numerals 52 and 54 therein for the lobe centers associated with the lobes 44 and 46 respectively.

Each of the lobes 44, 46 is pierced by a drive shaft aperture that is centered on a drive shaft axis extending from the lobe center of the lobe the aperture pierces. Thus, the first lobe 44 is pierced by a first drive shaft aperture 56 centered on a first drive shaft axis 58 extending radially from the lobe center 52 of the first lobe inner surface 48 and the second lobe 46 is similarly pierced by a second drive shaft aperture 60 centered on a second drive shaft axis 62 extending radially from the lobe center 54 of the second lobe inner surface 50. The lobe axes 56 and 62 are each disposed at an angle to the lobe axis 42 and are disposed coplanarly therewith as can be seen in FIG. 3. Such relationship has also been partially illustrated in FIGS. 19 and 20 which indicate certain geometrical relationships that are incorporated into the turbine 30. In particular, the plane formed by the drive shaft axes 58 and 62 is the XY plane of the coordinate system shown in FIGS. 19 and 20, the lobe axis 42 is the X axis of the coordinate system shown in FIGS. 19 and 20, such axis being designated with the lobe axis numeral 42, and the first drive shaft axis 58 is the axis designated by the first drive shaft axis numeral 58 in FIGS. 19 and 20.

Returning to FIG. 3, the turbine 30 further comprises bearings 64 and 66 disposed in the drive shaft apertures 56 and 60 respectively to support first and second drive shafts 72 and 74 respectively that extend through the wall of the housing 32 to provide for power take off from the turbine 30 as will be discussed below.

Figure 4:
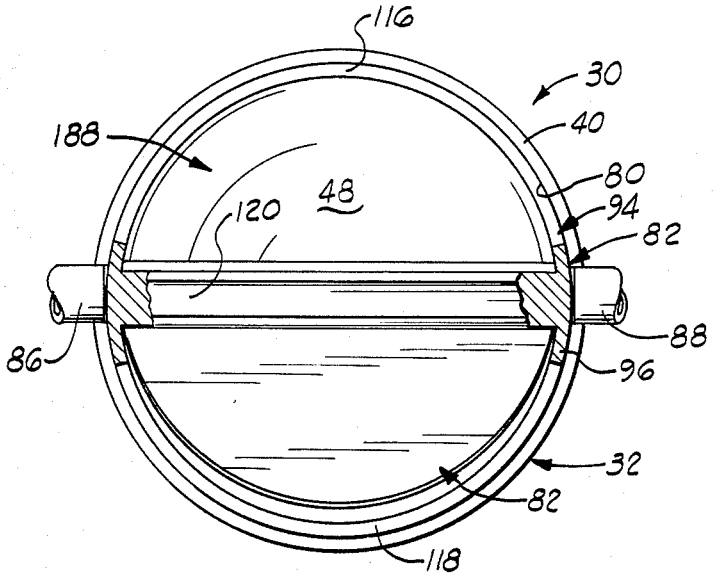
FIG. 4 is a cross section in partial cutaway of the turbine taken along line 4—4 of FIG. 3 for the position of the vane assembly shown in FIG. 3.
Figure 5:
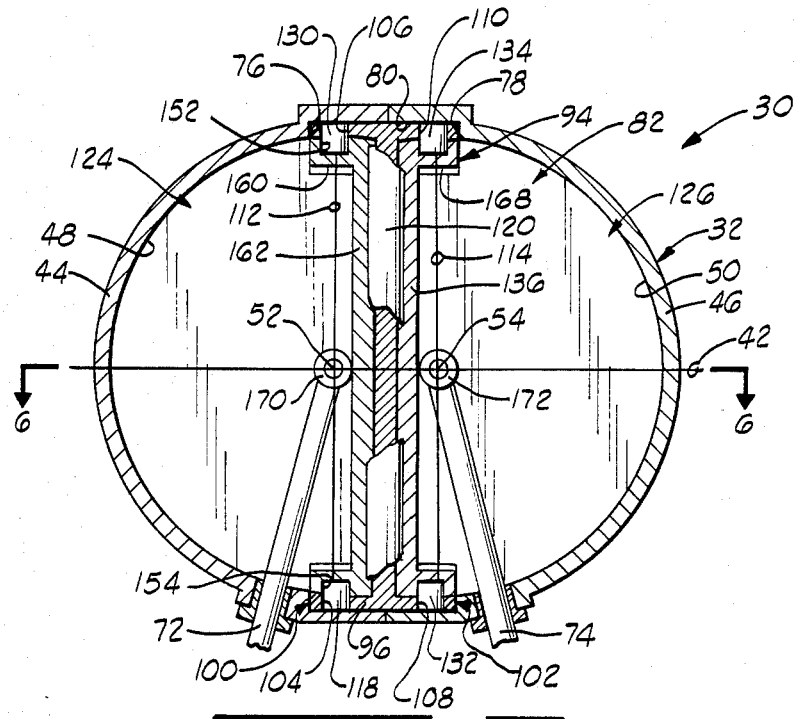
FIG. 5 is a cross section in partial cutaway of the turbine similar to FIG. 3 but illustrating a different position of the vane assembly within the casing.
Figure 6:
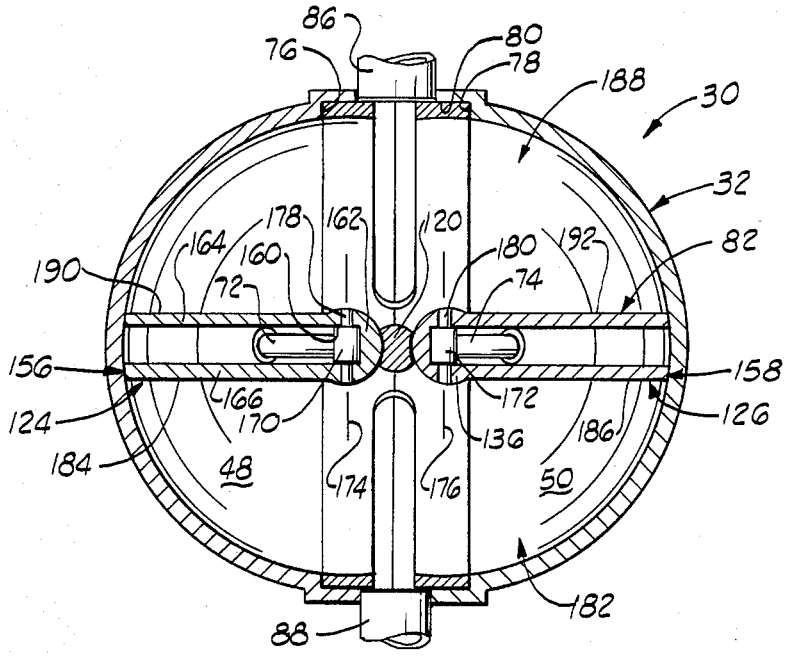
FIG. 6 is a cross section of the turbine taken along line 6—6 of FIG. 5 for the position of the vane assembly shown in FIG. 5.

As is also shown in FIG. 3 and as further shown in FIGS. 4 through 6, the housing center portion 40 is constructed on a diameter and has a wall thickness such that shoulders 76, 78 are formed in the interior of the housing 32 at each of the junctions between the housing center portion 40 and the lobes 44 and 46 so that the shoulders and the inner periphery of the housing center portion 40 coact to form a groove 80 that extends circumferentially about the lobe axis 42. The groove 80 supports a vane assembly generally designated by the numeral 82 within the housing 32 for rotation about the lobe axis 42. FIGS. 3 and 4 show the configuration of the vane assembly 82 for one position of the vane assembly 82 within the housing 32 and FIGS. 5 and 6 show a second configuration and position of the vane assembly 82 within the housing 32.

Referring once again to FIG. 1, a semi-circular cut-out is formed through each of the ring-shaped portions of the housing halves to form a circular aperture 84 that extends through the wall of the center portion 40 of the housing 32 at the top of the housing. A suitable conduit 86 is secured by any suitable means within the aperture 84 to form an inlet port for the turbine 30 and a similar conduit is similarly mounted in the housing 32 (see FIG. 2) to similarly form an outlet port for the housing 32. The flow of fluids through the turbine 30, produced by providing a suitable pressurized gas or combusting mixture at the inlet port while exhausting gases from the outlet port, has been indicated in FIGS. 19 and 20 by the arrows 90, for the inlet port, and 92, for the outlet port, disposed along the Z axis of the coordinate system shown in FIGS. 19 and 20. It will be noted that flow of gas into and out of the turbine 30 is thus along a line perpendicular to the plane formed by the drive shaft axes 58, 62 and the lobe axis 42 which, as noted above, are disposed in the XY plane of the coordinate system shown in FIGS. 19 and 20. The significance of the relationship between the directions of flow of gases into and out of the turbine 30 with respect to the plane of the drive shaft axes and lobe axis will become clear below.

Figure 7:
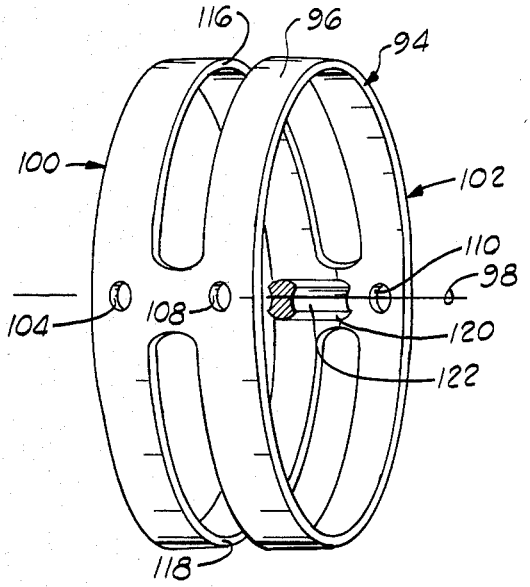
FIG. 7 is an isometric view, in partial cross section, of the vane support ring of the turbine shown in FIG. 1.

In the embodiment of the turbine shown in FIGS. 1 through 18, and as particularly shown in FIG. 3, the vane support assembly 82 is comprised of a vane support ring 94 which has been separately illustrated in FIG. 7. As shown therein, the vane support ring 94 is generally tubular in form, the ring 94 having a wall 96 that extends circularly about a vane support ring tube axis 98 between first and second ends, 100 and 102 respectively, of the vane support ring 94. As shown in FIG. 3, the vane support ring 94 is disposed within the groove 80 in the inside surface of the housing 32 so that the ends 100, 102 of the vane support ring 94 will engage the shoulders 76, 78 in the housing 32 to position the vane support ring 94 in the housing 32 for rotation about the lobe axis 42 which will coincide with the tube axis 98 of the vane support ring 94. In addition, and as also shown in FIG. 3, portions of the vane support ring 94 near the first end 100 thereof extend about the lobe center 52 of the first lobe inner surface 48 and such portions have an inner periphery that continues the partially spherical configuration of the first lobe inner surface 48 to the center of the vane support ring 94. Similarly, portions of the vane support ring 94 near the second end 102 thereof extend about the lobe center 54 of the second lobe inner surface 50 and such portions have an inner periphery that continues the partially spherical configuration of the second lobe inner surface 50 to the center of the vane support ring 94. The purpose of these features will become clear below.

Returning to FIG. 7 and referring also to FIG. 5, a pair of holes 104 (FIGS. 5 and 7) and 106 (FIG. 5) are formed through the wall 96 of the vane support ring 94 in diametric opposition near the first end of the vane support ring and a similar pair of diametrically opposed holes, 108 and 110, are formed through the wall 96 of the vane support ring 94 near the second end 102 thereof. The holes 104–110 are positioned so that, as particularly shown in FIG. 5, a diameter 112 of the vane support ring 94, upon which the holes 104, 106 are centered, will pass through the first lobe center 52 when the turbine 30 is assembled and, similarly, a diameter 114 of the vane support ring 94, upon which the holes 108, 110 are centered, similarly passes through the lobe center 54. That is, the diametrically opposed holes near each end of the vane support ring 94 are placed in axial alignment with the lobe center of the lobe into which such end of the vane support ring 94 opens. The purpose of such positioning of the holes 104–110 will become clear below.

In addition to passing through the lobe centers, 52, 54, the diameters 112, 114 are parallel to define a diametral mid-plane (not shown) for the vane support ring 94. (The mid-plane for the vane support ring 94 is also defined by either of the diameters 112, 114 and the tube axis 98 of the vane support ring 94.) To one side of the diametral mid-plane defined by the diameters 112, 114, a slot 116 (FIG. 7) is formed through the wall 96 of the vane support ring 94 to extend a distance along the periphery of the wall 96 of the vane support ring 94. Opposite the slot 116 and disposed symmetrically thereto with respect to the diametral mid-plane defined by the diameters 112, 114, a second slot 118 is similarly formed through the wall 96 of the vane support ring 94 to extend along the periphery of the wall 96. The slots 116, 118 are axially centered between the diameters 112, 114 and each of the slots 116, 118 extends along the periphery of the vane support ring 94 through nearly a semi-circular arc so that the lengths of the slots 116, 118 are large compared to the separations of the ends of the slots. The purpose of the slots 116, 118 and the preferred geometry of the slots shown in FIG. 7 will become clear below.

Formed integrally with the vane support ring 94 and disposed centrally between the diameters 112, 114 (FIG. 5) is a seal shaft 120 that extends diametrically across the vane support ring 94 in a parallel relation to the diameters 112, 114. The seal shaft, the construction of which is best shown in FIG. 7, has a generally rectangular shape with two sides thereof facing the diameters 112 and 114 along which the holes 104–110 are formed. These sides are dished in to form a concavo-cylindrical surface, such as the surface 122 in FIG. 7, that extends diametrically across the vane support ring 94 and each of these surfaces is centered on the diameter, 112 or 114, that the surface faces.

Referring once again to FIGS. 3 and 5, the vane assembly 82 further comprises a first vane 124 and an identical second vane 126 pivotally mounted on the vane support ring 94 via pins 128–134 (FIG. 5) that are mounted in the holes 104–110 respectively, through the wall 96 of the vane support ring 94, so that the vane 124 can pivot on the vane support ring 94 about the diameter 112 and the vane 126 can pivot on the vane support ring 94 about the diameter 114. The structure of the vanes 124, 126 has been particularly shown in FIG. 8 wherein is illustrated the second vane 126. As shown therein, the vane 126 is comprised of a generally cylindrical core 136, centered on a vane pivotation axis 138, and two spaced-apart, parallel plates 140, 142 that are joined with the core 136 and extend laterally therefrom between the ends 144, 146 of the core 136. (The ends of the core 136 form ends for the vane as a whole and will sometimes be referred to herein as the ends of the vane.) The plates 140, 142 have edges, 148 and 150 respectively, that extend arcuately between the ends 144, 146 of the core 136 and the edges 148, 150, as well as the vane ends 144, 146, are curved to conform to a portion of a spherical surface centered on the center of the vane pivotation axis 138 and having a radius equal to the radii of the lobe inner surfaces 48 and 50.

In order to mount the vane 126 on the vane support ring 94, sockets 152, 154 are formed in the ends 144, 146 of the core 136 to receive the pins 132 and 134 as shown in FIG. 5. The sockets 152, 154 are centered on the vane pivotation axis 138 so that the vane pivotation axis 138 will coincide with the diameter 114 of the vane support ring 94 when the vane 126 is mounted in the vane support ring 94. Thus, since the diameter 114 is positioned, via the positioning of the vane support ring 94 in the housing 32, to extend through the lobe center 54, the vane pivotation axis 138 will also extend through the lobe center 54 when the vane 126 is mounted on the vane support ring 94 and the vane support ring 94 is mounted in the housing 32. Moreover, because of the above recited shape of the edges 148, 150 of the plates 140, 142 and the ends 144, 146 of the core 136, such edges 148, 150 and ends 144, 146 will form a sealing surface on the vane 126 that will extend arcuately between the vane ends 144, 146 to mate with the lobe inner surface 50 when the vane assembly 82 is mounted in the housing 32. Additionally, the radius of the core 136 is selected so that the surface of the core 136 will engage the surface 122 on the seal shaft 128, along the length of the surface 122, to form a dynamic seal between the seal shaft 120 and the vane 126 when the vane 126 is mounted in the vane support ring 94. A similar dynamic seal is formed between the seal shaft 120 and the first vane 124 and a sealing surface, corresponding to the sealing surface on the second vane 126, is formed on the first vane 124 to mate with the first lobe inner surface 48 in the same manner that the sealing surface on the second vane 126 mates with the second lobe inner surface 50. These sealing surfaces, each comprised of the edges of the two plates of one of the vanes and the ends of the core of such vane, have been designated by the numerals 156, for the first vane 124, and 158, for the second vane 126, in FIG. 3.

Referring now to FIGS. 5 and 6, an axially extending groove 160 is formed in the side of the core, designated 162 in these Figures, of the first vane 124 between the plates, designated 164, 166 in FIG. 6, of the first vane 124 and a similarly positioned groove 168 is formed in the core 136 of the second vane 126, the grooves 160 and 168 extending nearly the lengths of the cores 162 and 136. These grooves permit the drive shafts 72, 74 to be pinned to the vanes 124, 126 respectively in a manner particularly shown in FIGS. 5 and 6. As seen in such Figures, the ends of the drive shafts 72, 74 disposed within the housing 32 terminate in tubular bearings 170, 172 respectively that have bearing axes 174, 176 respectively normal to the drive shaft axes 58, 62 shown in FIG. 3. The drive shafts 72, 74 are pinned to the vanes 124, 126 respectively via pins 178, 180 that extend through the bearings 170, 172 respectively and into a transverse bore (not numerically designated in the drawings) formed through the cores of the vanes transversely to the vane pivotation axes of the vanes. The lengths of the bearings 170, 172 and the positioning of the bearings on remaining portions of the drive shafts 72, 74 are selected so that the drive shaft axes 58 and 62 will intersect the lobe axis 42 at the lobe centers 52 and 54 respectively. Since the vane assembly 82, to which the drive shafts 72, 74 are attached, rotates about the lobe axis 42 which coincides with the tube axis 98 of the vane support ring 94, and since the vanes 124, 126 are positioned on the vane support ring so that the vane pivotation axes extend through the lobe centers, this attachment of the drive shafts 72, 74 to the vanes 124, 126 respectively will cause the drive shaft axes 58, 62 to extend radially from the lobe centers 52, 54 for all positions of the vane assembly 82 within the housing 32.

Figure 8:
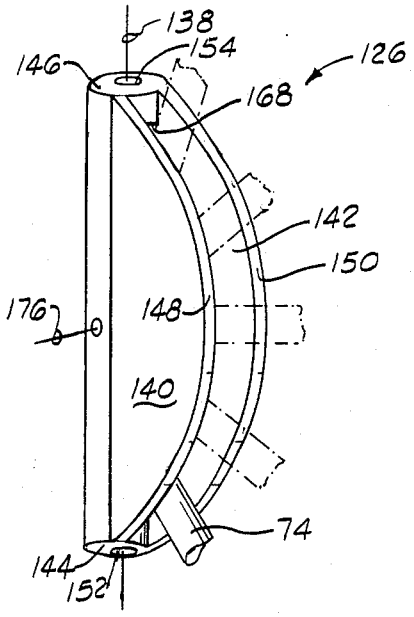
FIG. 8 is an isometric view of a vane used in the turbine of the present invention.

Referring to FIG. 8, it will be seen that the attachment of the drive shaft 74 to the second vane 126 via the bearing 172 and the pin 180 results in the second drive shaft 74 being pivotally connected to the second vane 126 for pivotation thereon about an axis normal to the vane pivotation axis 138 so that, considering the length of the groove 168 in the side of the core 136, the second drive shaft 74 can assume a variety of positions on the second vane 126 as has been indicated in phantom line in FIG. 8. The first drive shaft 72 can similarly pivot on the first vane 124 about an axis normal to the vane pivotation axis of the first vane 124 at the intersection of the vane pivotation axis of the first vane 124 with the first lobe center 52.

Before discussing the operation of the turbine 30, it will be useful to briefly to summarize the overall features of the turbine 30 with particular reference to FIGS. 3 through 6 which illustrate the internal configuration of the turbine 30 for two different positions, 90° apart, of the vane assembly 82 about the lobe axis 42. It will be seen in these Figures that movement of the various elements of the vane assembly 82 within the housing 32 is subject to three constraints. The vane support ring 94 is constrained to rotate about its tube axis which coincides with the lobe axis 42; the vanes are constrained to pivot on the vane support ring about their vane pivotation axes which intersect the lobe axis at the lobe centers; and the drive shafts are constrained to rotate about the drive shaft axes which extend radially from the lobe centers in a common plane that includes the lobe axis. Such plane is disposed normally to a line extending between inlet and outlet ports for the housing 32 formed by the semi-circular cuts formed through the walls of the housing halves at the housing center line and the conduits 86 and 88 attached to the housing 32.

These constraints limit the first vane 124 to movement within portions of the vane support ring 92 adjacent the first end 100 thereof and within the first lobe 44 so that, in view of the shape of the sealing surface 156 formed on the first vane 124, such sealing surface will always engage mating surfaces formed on the interior of the first lobe and in the bore of the vane support ring 94. Similarly, the second vane 126 is limited to movement within portions of the vane support ring 94 adjacent the second end 102 thereof and within the second lobe 46 with the sealing surface 158 formed on the second vane 126 always engaging mating surfaces formed on the interior wall of the housing and the bore of the vane support ring 94. Moreover, because of the symmetry of the mounting of the vanes 124, 126 on the vane support ring 94 and the positioning of the drive shaft axes 38, 62 with respect to the housing 32, the constraints will cause the vanes 124, 126 to always be oriented in mirror positions relative to the housing center line 38 (FIG. 1) at which the lobe halves 34 and 36 meet and also with respect to the medial plane of the vane support ring 94 defined by the parallel vane pivotation axes of the vanes 124, 126 resulting from the pinning of the vanes 124, 126 to the vane support ring 94 along parallel diameters of the vane support ring 94.

In view of the dynamic seal formed between the two vanes 124, 126 by the seal shaft 120, the shapes of the vanes 124 and 126, and their mounting such that the sealing surfaces 156 and 158 always engage the lobe inner surfaces 48 and 50 and portions of the bore of the vane support ring 94 disposed axially to the sides of the seal shaft 120, results in the division of the interior of the housing 32 into two non-communicating chambers that circle the lobe axis 42 as the vane support ring rotates about the lobe axis and expand and contract with changes in the position of the vane assembly 82 in the housing 32. One chamber, designated by the numeral 182 in FIGS. 3 and 6 is defined by one side 184 of the vane 124, one side 186 of the vane 126, the seal shaft 120, and portions of both lobe inner surfaces 48 and 50 and the bore of the vane support ring 92 disposed to one side of the medial plane of the vane support ring that passes through the vane pivotation axes of the two vanes. The other chamber, designated by the numeral 188 in FIGS. 3 and 6 is defined by the side 190 of the first vane 124, the side 192 of the second vane 126, the seal shaft 120 and remaining portions of the lobe inner surfaces 48 and 50 and the bore of the vane support ring 92.

As can be particularly seen in FIG. 4, rotation of the vane support ring 94 will cause portions of the wall 96 thereof between the ends of the slots 116, 118 to periodically align with the housing inlet and outlet ports at the conduits 86 and 88 respectively so that neither of the chambers 182, 188 will fluidly communicate with the turbine inlet or outlet. (The time period for such fluid non-communication can be made as short as desired by selecting the extent of the slots 116, 118 and the extents of the inlet and outlet ports along the periphery of the center portion 40 of the housing 32.) However, for positions of the vane support ring 94 to either side of the position shown in FIG. 4, one of the chambers 182, 188 will communicate with the inlet port, as does the chamber 188 in FIG. 6, while the other of the chambers 182, 188 will communicate with the outlet port, as does the chamber 182 in FIG. 6. For purposes of discussing the operation of the turbine 30, it will be useful to refer to the particular chamber that is in communication with the inlet port at any given time as the "inlet" chamber and to refer to the other chamber, which will concurrently be in communication with the outlet port, as the "outlet" chamber. It will thus be seen that, as the vane assembly 82 rotates, the inlet chamber will, at times, be located to the side 184 of the first vane 124 and the side 186 of the second vane 126, while the outlet chamber is located to the side 190 of the first vane 124 and the side 192 of the second vane 126, and at other times the inlet chamber will be located to the side 190 of the first vane 124 and the side 192 of the second vane 126, while the outlet chamber is located to the side 184 of the first vane 124 and the side 186 of the second vane 126. The sides of the vanes to which the inlet and outlet chambers are disposed will reverse each time the vane assembly 82 moves into the position shown in FIG. 4.

It will also be useful to briefly consider the manner in which the turbine 30 can be assembled before discussing the operation of the turbine. Initially, the vane assembly 82 can be assembled with the drive shafts 72 and 74 to provide a single unit to be mounted in the housing 32 by first pinning the drive shafts to the vanes 124, 126 and then pinning the vanes 124, 126 to the vane support ring 94. Prior to the mounting of the vanes on the vane support ring, suitable seal elements (not shown) can be mounted in the sealing surfaces 156, 158 if such seals are required in the application to which the turbine is to be put and suitable sealing elements (not shown) can similarly be mounted in the dished in surfaces of the seal shaft 120 if needed. Following this initial partial assembly, the first drive shaft can be inserted through the aperture 56, with the bearing 64 removed, and the vane support ring 94 can then be moved into portions of the groove 80 in the first housing half 34. (Just as suitable sealing elements can be disposed in the sealing surfaces 156 and 158 and in the dished in surfaces of the seal shaft 120, suitable sealing elements; for example, conventional piston rings, can be mounted in the outer periphery of the vane support ring 94 before mounting the vane assembly 82 in the housing 32.) The second drive shaft 74 is then inserted through the aperture 60 and the second housing half 36 is brought around portions of the vane assembly protruding from the first housing half 34 and the two housing halves 34, 36 are secured together to enclose the vane assembly 82 in the turbine housing 32. The assembly is completed by securing the bearings 64 and 66 within the apertures 56 and 60 respectively about the drive shafts 72 and 74 respectively.

OPERATION OF THE PREFERRED EMBODIMENT

Figure 9:
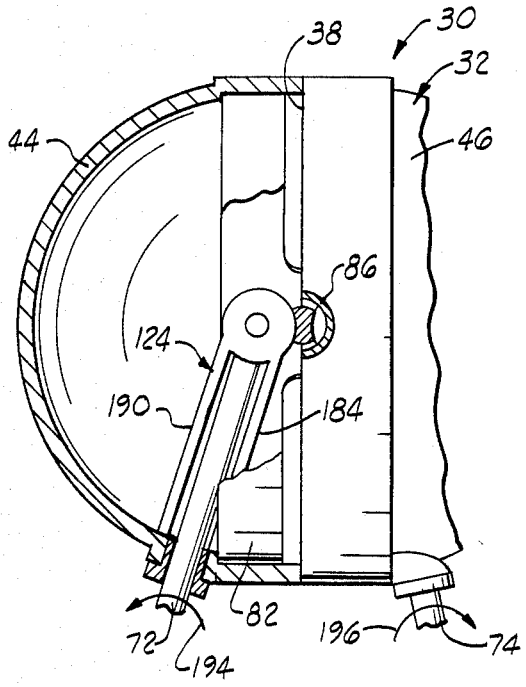
FIGS. 9, 11, 13, 15 and 17 are plan views, in partial cross section and cutaway, of the turbine shown in FIG. 1 illustrating different positions of the vane assembly during the operation of the turbine.
Figure 10:
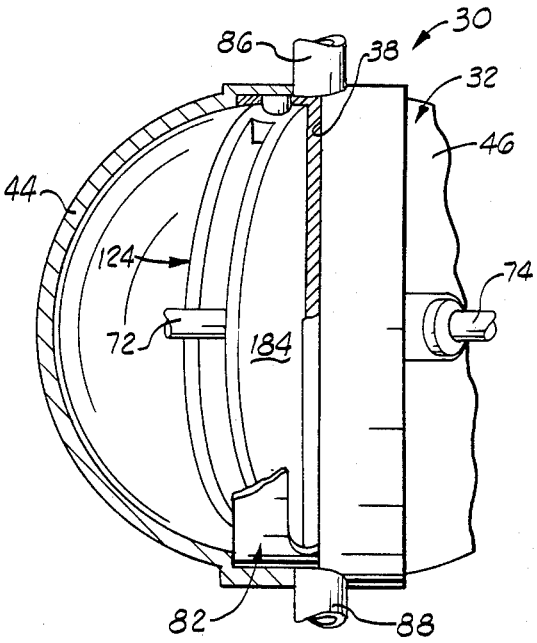
FIGS. 10, 12, 14, 16 and 18 are front elevational views, in partial cross section and partial cutaway, corresponding to FIGS. 9, 11, 13, 15 and 17 respectively.
Figure 11:
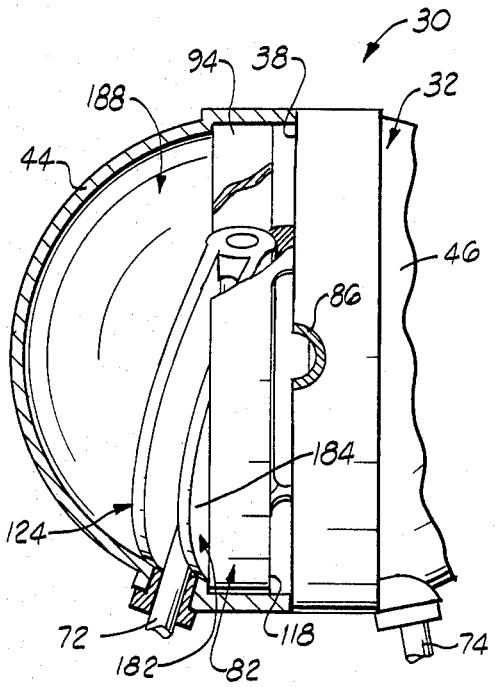
Figure 12:
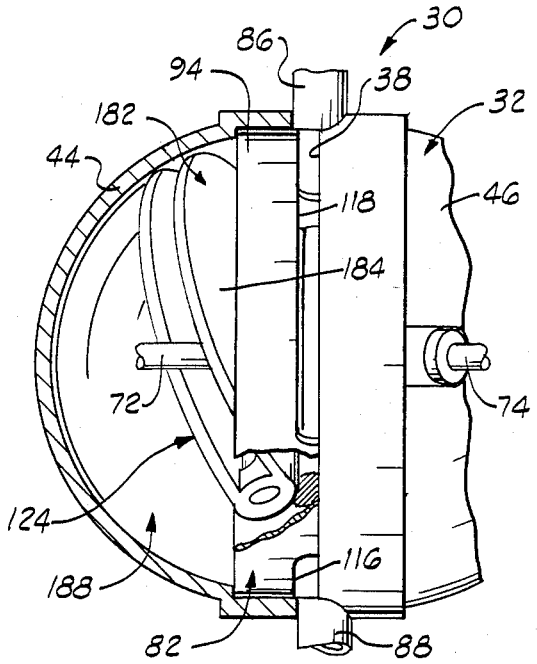
Figure 13:
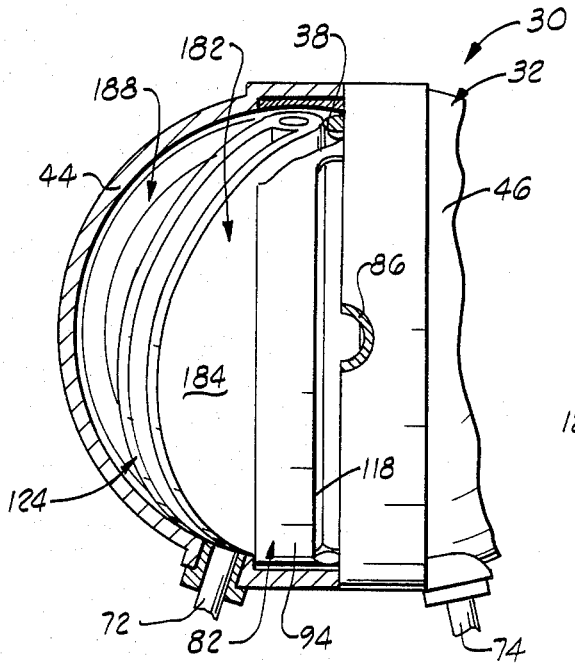
Figure 14:
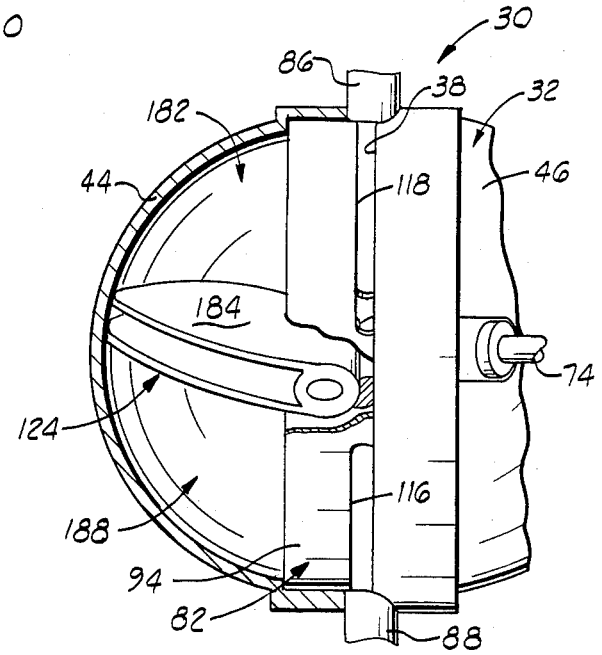
Figure 15:
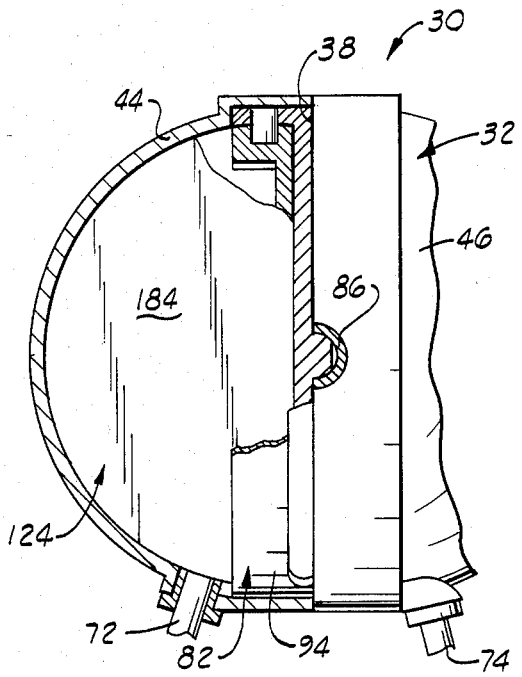
Figure 16:
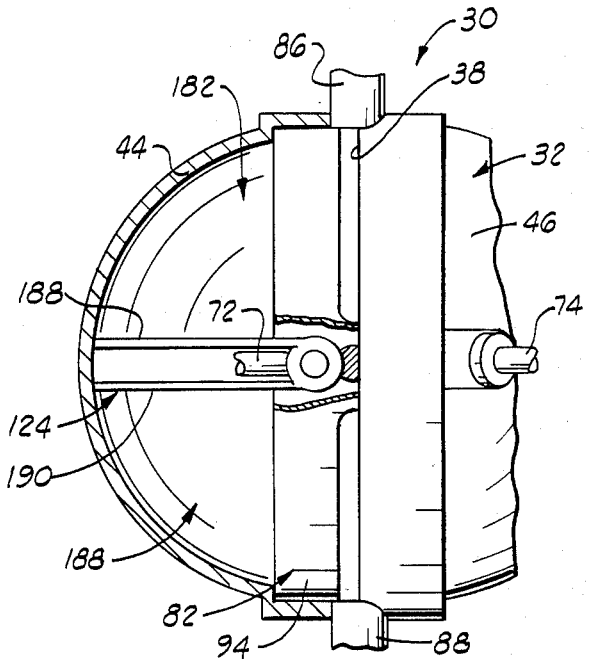

As has been noted above, the vanes 124, 126 are positioned within the housing 32 in mirror relation with respect to the housing center line 38 when the vane assembly 82 is mounted in the housing 32 so that only one side of the interior of the housing 32 need be considered to treat the operation of the turbine 30. Accordingly, FIGS. 9–18, which illustrate such operation during one-half revolution of the vane assembly 82, present simplified views of the turbine 30 for various positions of the vane assembly 82 by illustrating only the movement of the first vane 124 within the first lobe 42. Because of the described symmetry, the second vane 126 (not shown in these Figures) will undergo similar movements within the second lobe 46. As a further simplification to an understanding of the operation of the turbine 30, the FIGS. 9–18 have been arranged in pairs; that is, FIGS. 9 and 10 illustrate one configuration of the turbine 30 in plan and front elevational view respectively; FIGS. 11 and 12 illustrate a different configuration in plan and front elevation respectively; and similar pairs of views are shown in FIGS. 13 and 14, 15 and 16, and 17 and 18 respectively.

Figure 19:
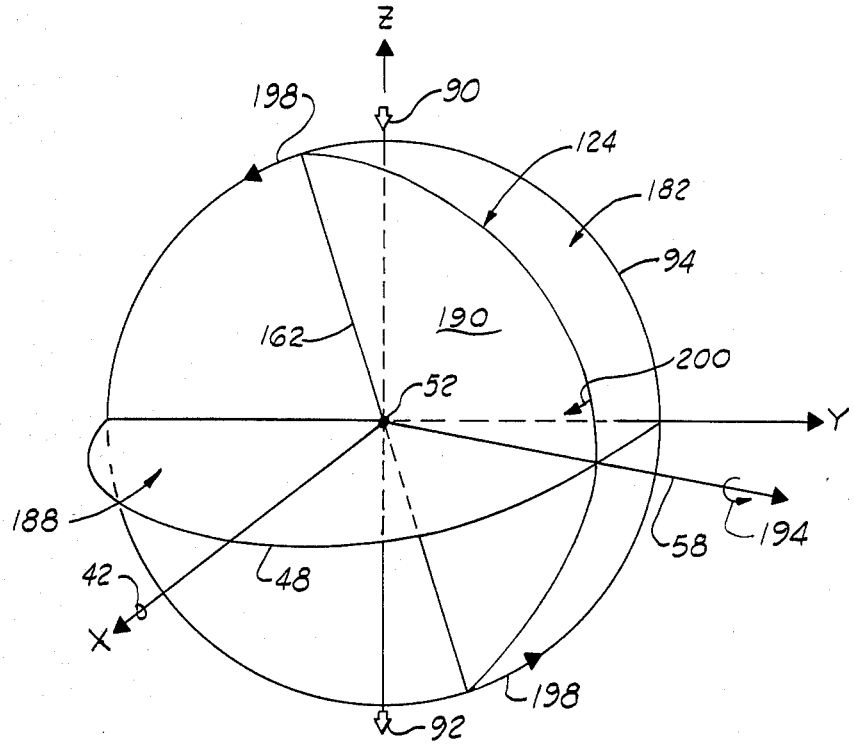
FIGS. 19 and 20 are stylized representations of portions of the turbine illustrating geometrical characteristics of the turbine.
Figure 20:
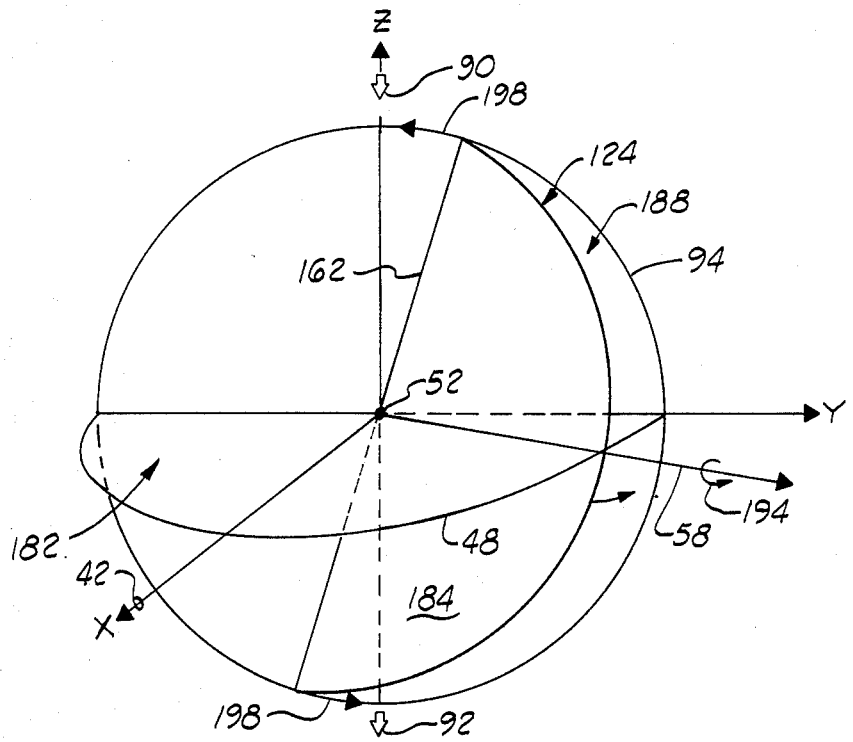

An even further simplification illustrating the operation of the turbine 30 has been presented in FIGS. 19 and 20 which are schematic representations of the interior of the first housing half 34 with many of the physical dimensions of the elements of the turbine 30 eliminated to bring out those features of the elements that are particularly associated with the operation of the turbine 30. Thus, in FIGS. 19 and 20, the first lobe inner surface 48 has been represented by the arc designated 48 and disposed in the XY plane in FIGS. 19 and 20; the vane support ring 94 has been represented as a circle, designated by the numeral 94, and disposed in the YZ plane in FIGS. 19 and 20; the vane 124 has been represented as a semi-circular sheet, numbered 124 in accordance with the numbering of the first vane, extending from a line, numbered 162 and corresponding to the vane pivotation axis extending along the center of the core 162 of the first vane 124, and the sheet having sides numbered 190 (FIG. 19) and 184 (FIG. 20) to conform to the numbering of the sides of the vane 124 in FIGS. 3 and 6; and the first drive shaft 72 has been represented by the number 58 corresponding to the first drive shaft axis 58 along which the first drive shaft 72 extends.

For purposes of discussion, it will be assumed that the turbine 30 is being operated as an internal combustion engine with burning fuel being introduced into the inlet port, symbolized by the arrow 90 in FIGS. 19 and 20 and formed by the conduit 86 in FIGS. 9–18, and with combustion products being exhausted from the exhaust port that has been symbolized by the arrow 92 in FIGS. 19 and 20 and formed by the conduit 88 in FIGS. 10, 12, 14, 16 and 18. (The turbine 30 can also be operated as an external combustion engine by connecting the conduit 86 to a suitable boiler.)

Beginning with FIGS. 9 and 10, the vane assembly 82 is shown for the position in which the chambers disposed to opposite sides 184 and 190 of the first vane 124 undergo a reversal from inlet chamber to outlet chamber and from outlet chamber to inlet chamber as the vane assembly 82 moves through such position. At this reversal position, the inflow to the turbine and exhaust therefrom are momentarily interrupted so that neither chamber is the inlet or the outlet chamber. From such position, the turbine 30 can be started either with a suitable starter motor attached to the drive shafts 72, 74 or, in the case of small turbines, by manually turning the shafts 72, 74 in the directions indicated by the arrows 194 and 196 respectively in FIG. 9. (See also FIGS. 19 and 20 wherein the direction 194 is illustrated.) Once the turbine has been started, the pressure of the gases trapped within the chamber that is the inlet chamber for each half revolution of the vane assembly 82 will carry the vane assembly 82 through the inlet-outlet chamber reversal position that is shown in FIGS. 9 and 10.

Because of the connection between the drive shaft 72, 74 and the vanes 124, 126, the rotation of the drive shaft 72, 74 in the directions 194, 196 will be accompanied by a rotation of the vane support ring 94 in the direction shown by the arrows 198 at the ends of the first vane pivotation axis 162 in FIGS. 19 and 20 and a pivotation of the first vane 124 about the vane pivotation axis 162 in the direction shown by the arrow 200 in FIG. 19. Thus, the turbine 30 will move to a configuration shown in FIGS. 11 and 12.

Once the vane assembly 82 has moved to a position such as that shown in FIGS. 11, 12 and 19, the inlet port will communicate with the chamber adjacent the side 184 of the first vane 124 via the slot 118 formed through the wall of the vane support ring 94 and the outlet port will communicate with the chamber adjacent the side 190 (not visible in FIGS. 11 and 12) of the first vane 124 so that the chamber 182 becomes an inlet chamber while the chamber 188 becomes an outlet chamber. (See also FIG. 19.) Thus, a pressure differential will exist between the sides of the first vane 124 tending to expand the inlet chamber 182 and collapse the outlet chamber 188. That is, the first vane 124 will be forced toward continued movement in the direction 200 shown in FIG. 19. Because of the constraints on movement of portions of the turbine 30 described above, and in particular the constraint that the drive shaft 72, which is disposed between the plates of the first vane 124, extend through an aperture having a fixed position on the housing 32 so that the space between the plates of the first vane 24 must always align with such aperture, as indicated by the intersection of the arcuate edge of the sheet 124 with the axis 58 in both FIGS. 19 and 20, the pivotation of the first vane 124 about its vane pivotation axis is accompanied by a continued rotation of the vane support ring 94 in the direction shown by the arrows 198 in FIG. 19 and by a continued rotation of the first drive shaft 72 in the direction 194 shown in FIGS. 9 and 19. Thus, the turbine 30 will move to a configuration such as that shown in FIGS. 13 and 14. In such configuration, and for all configurations through those shown successively in FIGS. 15 and 16 and FIGS. 17 and 18, the slot 118 will continue to communicate the chamber 182 with the inlet port and the slot 116 will continue to communicate the chamber 188 with the outlet port so that the vane assembly is driven through the positions shown consecutively from FIGS. 11 and 12 to FIGS. 17 and 18 with the inlet chamber, chamber 182 in FIGS. 11 and 12, continuously expanding and the outlet chamber, chamber 188 in FIGS. 11–18, continuously collapsing. Thus, the turbine 30 moves from a configuration in which the inlet chamber is small and the outlet chamber large as shown in FIG. 19 to a converse configuration shown in FIG. 20 under a continuous pressure differential across the vanes 124, 126 resulting from the continuous communication of the inlet chamber with the inlet port and the outlet chamber with the outlet port. As a result, the drive shafts 72, 74 are continuously driven in the directions 194 and 196 shown in FIG. 9 during the movement of the vane assembly through the positions shown consecutively in FIGS. 11 and 12, 13 and 14, 15 and 16, and 17 and 18.

Figure 17:
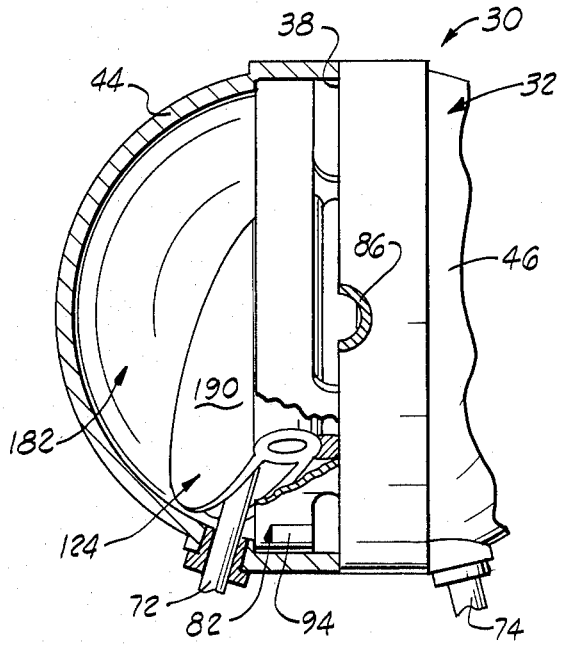
Figure 18:
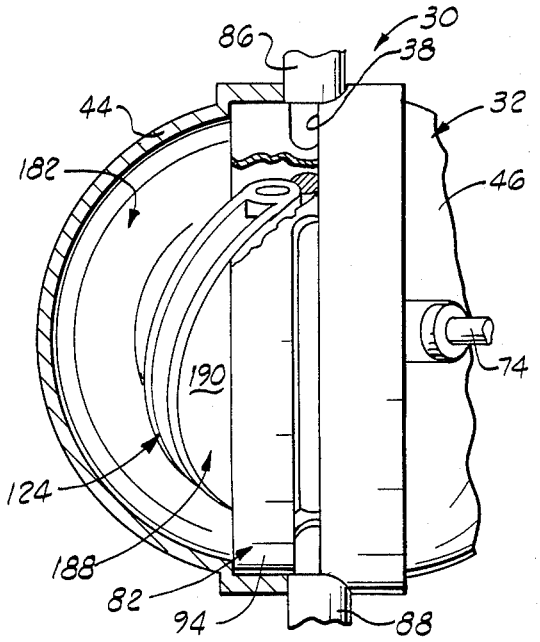

Shortly after the turbine 30 reaches the configuration shown in FIGS. 17 and 18, the turbine 30 will return to the configuration shown in FIG. 9 except that the sides 184 and 190 of the first vane 124 (as well as the sides of the second vane 126) will be reversed from the positions shown in FIG. 9. Such reversal is caused by the synchronous rotation of the vane pivotation axes through one half turn about the lobe axis 42 while the vanes pivot from one extreme position on the vane support ring to an opposite extreme position thereon during the expansion of one chamber and the collapse of the other chamber and has been indicated by the numbering of the sides of the sheet 124 in FIGS. 19 and 20. At the time that the vane assembly 82 returns to the inlet-outlet chamber reversal position, pressurized fluid will be contained within the smaller of the two chambers; that is, the chamber 188, while relatively low pressure gas will be contained within the larger chamber; that is, chamber 182, so that the vane assembly will be forced to continue the pivotation about the lobe axis 42. Thus, once the turbine 30 has been started, it will operate continuously with the drive shafts turning in the directions 194, 196 shown in FIG. 9.

In the above discussion of the operation of the turbine 30, it has been assumed that the turbine 30 is operated as an engine and, further, that the turbine 30 is driven to cause the drive shafts to turn in the directions 194 and 196 shown in FIG. 9. The turbine 30 is not limited to such operation. In particular, the direction of rotation of the drive shafts 72, 74, when the turbine is used as an engine, can be reversed by merely reversing the inlet and outlet ports to the housing. For example, if the turbine 30 is connected to a boiler to operate as an external combustion engine, the drive shafts will turn in the directions shown in FIG. 9 when the conduit 86 is connected to the boiler and will turn in directions opposite to those shown when the conduit 88 is connected to the boiler. Similarly, the turbine 30 can be operated as a pump, for pumping fluid in either direction through the turbine, by turning the drive shafts 72, 74 and communicating the conduits 86 and 88 to a fluid to be pumped.

DESCRIPTION OF FIGS. 21 THROUGH 23

Figure 21:
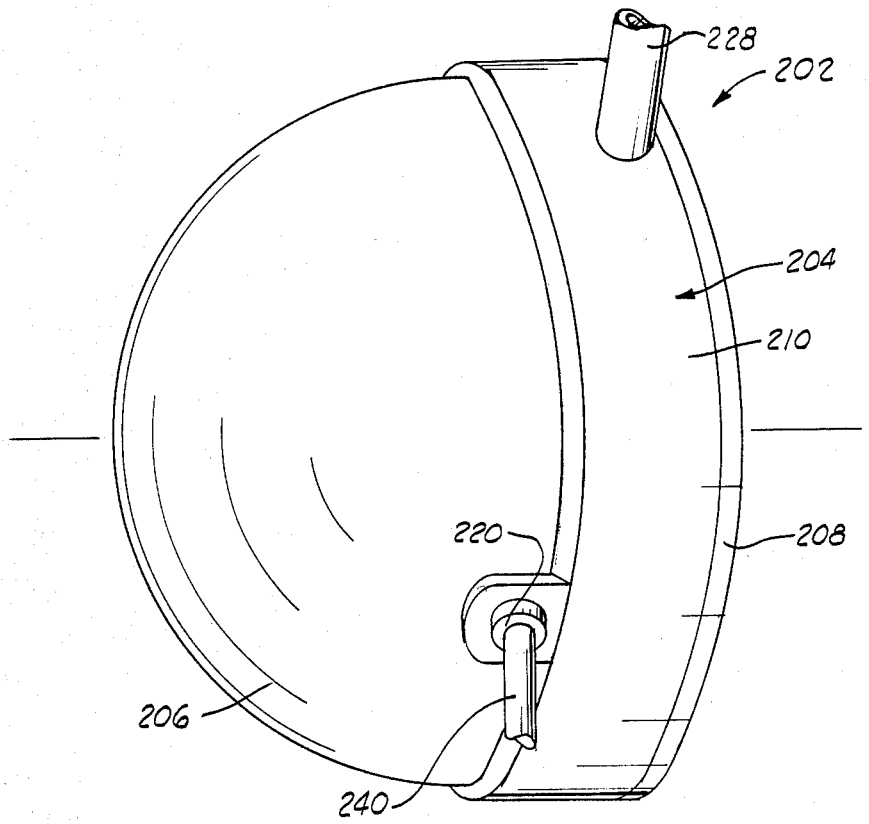
FIG. 21 is an isometric view of a second embodiment of the turbine.
Figure 22:
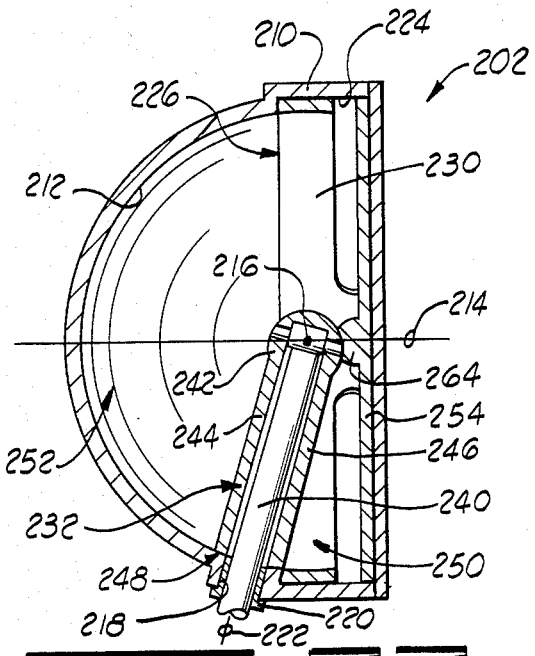
FIG. 22 is a cross section in plan view of the turbine shown in FIG. 21.
Figure 23:
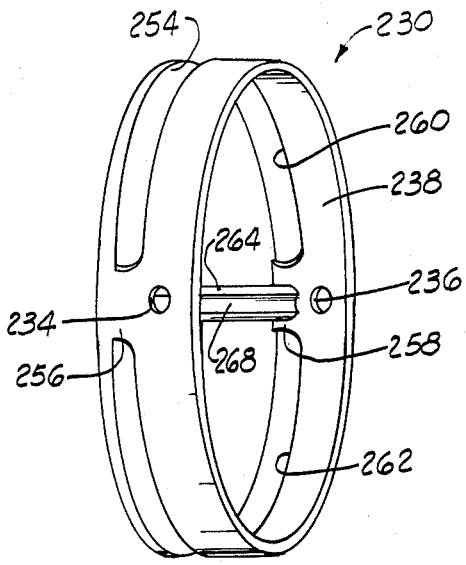
FIG. 23 is an isometric view of the vane support ring used in the turbine shown in FIG. 21.

FIGS. 21 through 23 illustrate a second embodiment, designated by the general reference numeral 202, of a turbine constructed in accordance with the present invention. The turbine 202 is comprised of a housing 204 which includes only one lobe 206, the second lobe of the turbine 30 being replaced in the turbine 202 by a closure plate 208 that is attached to a housing end portion 210 that is equivalent to the housing center portion 40 of the turbine 30. Like the first lobe 34 of the turbine 30, the lobe 206 of the turbine 202 has a partially spherical lobe inner surface 212 that is disposed cylindrically symmetrically about a lobe axis 214 and is centered on a lobe center 216. A drive shaft aperture 218, in which is disposed a bearing 220, is formed through the wall of the lobe 206 about a drive shaft axis 222 that, like the drive shaft axis 58 in the turbine 30, extends radially from the lobe center of the lobe the drive shaft axis pierces; that is, the lobe center 216 for the turbine 202. The inner wall 214 of the end portion 210 is constructed on a radius slightly larger than the radius of curvature of the lobe inner surface 212 to support and position a vane assembly 226 in the housing 204 in the same manner that the vane assembly 82 is supported and positioned in the housing 32 of the turbine 30. An inlet 228 to the interior of the housing 204 is provided through the housing end portion 210, adjacent the closure plate 208, so that combusting fuel or other fluid can be introduced into the turbine 202. Diametrically opposed to the inlet 228, is an outlet (not shown) that is used to provide an exhaust from the turbine 202 in the same manner that an outlet port is formed in the housing central portion 40 of the housing 32 of the turbine 30. Like the inlet and outlet of the turbine 30, the inlet and outlet of the turbine 202 are disposed along a line perpendicular to a plane defined by the lobe axis 214 and the drive shaft axis 222.

The vane assembly 226 is comprised of a modified vane support ring 230 which supports a vane 232, that is identical to the vanes 224, 226, via pins (not shown) that extend into the ends of the vane 232 from holes 234, 236 formed in diametric opposition through the wall 238 of the vane support ring 230. As in the case of the pairs of holes 104, 106 and 108, 110 in the vane support ring 94, the pair of holes 234, 236 are positioned on the vane support ring 230 to lie along a diameter thereof that passes through the lobe center 216 when the vane assembly 226 is mounted in the housing 204 so that the vane pivotation axis (not shown) of the vane 232 will pass through the lobe center 216 when the vane assembly 226 is mounted in the casing 204. Similarly, the bore of the vane support ring 230 is configured to continue the spherical shape of the lobe inner surface 212 so that the vane 232 can pivot in the vane support ring 230 in the same manner that the vanes 124, 126 pivot in the vane support ring 94. A drive shaft 240 is attached to the vane 232 in the same manner that the drive shafts 72, 74 are attached to the vanes 124, 126 and is attached at the lobe center 216 to pivot on the core 242 of the vane 232, between plates 244, 246 having edges defining a sealing surface 248 that engages the lobe inner surface 212, as the vane assembly 226 rotates about the lobe axis 214.

The modification of the vane support ring 230 enables the vane 232 to form two chambers, 250, 252 that orbit the lobe axis 214, one chamber expanding while the other collapses, comparable to the two chambers 182, 188 formed in the turbine 30. To this end, fluid communication between the sides of the vane 232 must be blocked, a function that is performed for each vane 124, 126 in the turbine 30 by the seal shaft 120 and the other of the vanes 124, 126. In the turbine 202, such blocking of fluid communication between the sides of the vane 232 is accomplished by plate 254 that is attached to one end of the vane support ring 230, defined by the ends of diametrically opposed webs 256, 258 that space major portions of the vane support ring 230 from the plate 254 to form slots 260, 268 through the wall 238 of the vane support ring 230 to communicate the chambers 250, 252 with the casing inlet and outlet in the manner that such communication is effected by the slots 116, 118 in the turbine 30. The blockage of fluid communication between the chambers 250, 252 is then completed by a ridge 264 that is formed on the plate 254, parallel to a line between the centers of the holes 234, 236, and has a dished in surface 268 that mates with the surface of the core 242 of the vane 232 to form a dynamic seal between the vane 232 and plate 254 in the same manner that a dynamic seal is formed between the vanes 124, 126 of the turbine 30. The operation of the turbine 202 is substantially the same as the operation of the turbine 30, differing in that only one vane and the plate 254 are used to form the inlet and outlet chambers in the turbine 202 as opposed to the formation of such chambers by the two vanes 124, 126 in the turbine 30.

It will be clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A turbine, comprising:

a housing including at least one lobe having a lobe inner surface symmetrically disposed about a lobe axis and conforming to a portion of a spherical surface centered on a lobe center disposed on the lobe axis, wherein a drive shaft aperture intersecting the lobe inner surface is formed through the housing along a drive shaft axis extending radially from the lobe center at an angle to the lobe axis;

a vane having a vane pivotation axis extending therethrough, wherein a sealing surface is formed on the vane to mate with the lobe inner surface, the sealing surface extending arcuately about the center of the vane pivotation axis between opposite ends of the vane pivotation axis;

means for mounting the vane within the housing for simultaneous pivotation of the vane about the vane pivotation axis and rotation of the vane about the lobe axis with the vane pivotation axis extending through the lobe center perpendicularly to the lobe axis;

a drive shaft passing through the drive shaft aperture and pivotally connected to the vane for pivotation relative thereto about an axis passing through the lobe center normally to the vane pivotation axis;

means for blocking fluid communication between opposite sides of the vane separated by the vane sealing surface so as to form a turbine inlet chamber to one side of the vane and a turbine outlet chamber to the other side of the vane, the sides of the vane to which the inlet and outlet chambers are formed reversing for a selected position of the vane pivotation axis in the casing;

an inlet port providing fluid inlet means to the lobe interior, the inlet port positioned on the housing to provide fluid communication with the turbine inlet chamber; and an outlet port providing fluid outlet means to the lobe interior, the inlet port positioned on the housing to provide fluid communication with the turbine outlet chamber.

2. The turbine of claim 1 wherein the means for mounting the vane within the housing comprises a tubular vane support ring mounted in the housing for rotation about the lobe axis, the vane support ring positioned in the housing to extend about the lobe center with the tube axis of the vane support ring coincident with the lobe axis; and wherein the vane is pinned to the vane support ring at opposite ends of the vane pivotation axis such that the vane pivotation axis extends along a diameter of the vane support ring.

3. The turbine of claim 2 wherein two slots are formed through diametrically opposed portions of the tubular wall of the vane support ring, each slot disposed to one side of the vane pivotation axis and extending a distance along the periphery of the vane support ring; and wherein the inlet and outlet ports are positioned on the housing to alternately align with said slots as the vane support ring rotates in the housing.

4. The turbine of claim 3 wherein each of said slots is centered on a diameter of the vane support ring perpendicular to the vane pivotation axis and wherein the distances separating the ends of one slot from the ends of the other slot are smaller than the lengths of the slots along the periphery of the vane support ring.

5. The turbine of claim 2 wherein the vane comprises:

a generally cylindrical core extending axially along the vane pivotation axis; and two spaced apart, parallel plates extending from one side of the vane core, each plate having an arcuate edge shaped to conform to the lobe inner surface extending from one end of the vane core to the other end of the vane core; and wherein the drive shaft extends through the space between the plates of the vane and is pivotally connected to the vane core.

6. The turbine of claim 2 wherein the housing is characterized as including a second lobe having a second lobe inner surface symmetrically disposed about said lobe axis and conforming to a portion of a spherical surface centered on a second lobe center disposed on the lobe axis within the vane support ring; wherein the means for blocking fluid communication between opposite sides of said vane comprises:

a second vane pinned to the vane support ring for pivotation about a vane pivotation axis extending along a diameter of the vane support ring to intersect the second lobe center, the second vane having a sealing surface formed thereon to extend arcuately between the ends of the vane pivotation axis of the second vane to mate with the second lobe inner surface and the vane pivotation axes of the two vanes being disposed in a parallel, spaced-apart relation; and means for forming a dynamic seal between the two vanes of the turbine;

wherein a second drive shaft aperture intersecting the second lobe inner surface is formed through the housing along a second drive shaft axis extending radially from the second lobe center at an angle to the lobe axis, the two drive shaft axes and the lobe axis being disposed coplanarly; and wherein the turbine further comprises a second drive shaft, the second drive shaft passing through the second drive shaft aperture and pivotally connected to the second vane for pivotation relative thereto about an axis passing through the second lobe center normally to the second vane pivotation axis.

7. The turbine of claim 6 wherein each of the vanes comprises:

a generally cylindrical core extending axially along the vane pivotation axis of the vane; and two spaced apart, parallel plates extending from one side of the vane core, each plate having an arcuate edge shaped to conform to the lobe inner surface with which the sealing surface on the vane is mated, the arctuate edges of the plates extending from one end of the vane core to the other end thereof; and wherein the drive shaft connected to each of the vanes extends through the space between the plates of the vane and is pivotally connected to the vane core of the vane.

8. The turbine of claim 7 wherein the means for forming a dynamic seal between the two vanes of the turbine comprises a seal shaft extending along a diameter of the vane support ring between the vane pivotation axes and parallel to the vane pivotation axes, the seal shaft having dished surfaces formed in sides thereof facing the vane pivotation axes to mate with portions of the peripheries of the cores of the vanes.

9. The turbine of claim 6 wherein each of the vanes comprises a generally cylindrical core extending axially along the vane pivotation axis of the vane and wherein the means for forming a dynamic seal between the two vanes of the turbine comprises a seal shaft extending along a diameter of the vane support ring between the vane pivotation axes and parallel to the vane pivotation axes, the seal shaft having dished surfaces formed in sides thereof facing the vane pivotation axes to mate with portions of the peripheries of the cores of the vanes.

10. The turbine of claim 2 wherein the means for blocking fluid communication between opposite sides of the vane comprises:

a plate extending across one end of the vane support ring; and means formed on said plate for forming a dynamic seal between the plate and the vane.

11. The turbine of claim 10 wherein the vane comprises a generally cylindrical core extending axially along the vane pivotation axis of the vane and wherein the means formed on the plate for forming a seal between the vane and the plate is characterized as comprising a ridge formed on the plate to extend diametrically across the vane support ring and having a dished side facing the vane pivotation axis to mate with portions of the cylindrical core of the vane.

12. The turbine of claim 11 wherein the vane further comprises two spaced-apart, parallel plates extending from one side of the vane core, each plate having an arcuate edge shaped to conform to the lobe inner surface extending from one end of the vane core to the other end of the vane core; and wherein the drive shaft extends through the space between the plates of the vane and is pivotally connected to the vane core.

13. The turbine of claim 1 wherein the vane comprises:

a generally cylindrical core extending axially along the vane pivotation axis; and two spaced apart, parallel plates extending from one side of the vane core, each plate having an arcuate edge shaped to conform to the lobe inner surface extending from one end of the vane core to the other end thereof; and wherein the drive shaft extends through the space between the plates of the vane and is pivotally connected to the vane core.

14. A turbine, comprising:

a vane assembly, comprising:

a tubular vane support ring having a first end and a second end;

a first vane mounted on the vane support ring near the first end thereof, the first vane supported on the vane support ring for pivotation thereon about a first vane pivotation axis extending diametrically across the vane support ring and the first vane having a sealing surface, shaped to conform to a portion of a spherical surface centered on the center of the first vane pivotation axis, formed thereon to extend between the ends of the first vane pivotation axis;

a second vane mounted on the vane support ring near the second end thereof, the second vane supported on the vane support ring for pivotation thereon about a second vane pivotation axis extending diametrically across the vane support ring in a parallel, spaced-apart relation to the first vane pivotation axis and the second vane having a sealing surface, shaped to conform to a portion of a spherical surface centered on the center of the second vane pivotation axis, formed thereon to extend between the ends of the second vane pivotation axis, wherein two slots are formed through portions of the wall of the vane support ring disposed between the first and second vane pivotation axes, one aperture positioned to either side of the plane of the vane pivotation axes; and means for forming a dynamic seal between the two vanes;

a housing enclosing the vane assembly, the housing comprising:

a housing center portion extending about the vane support ring in a concentric relation thereto so as to support the vane assembly for rotation about the axis of the vane support ring;

a first lobe attached to the housing center portion at the first end of the vane support ring, the first lobe having an inner surface shaped to mate with the sealing surface on the first vane, wherein a first drive shaft aperture is formed through the wall of the housing along a first drive shaft axis extending radially from the center of the first vane pivotation axis at an angle to the vane support ring axis to intersect the inner surface of the first lobe; and a second lobe attached to the housing center portion at the second end of the vane support ring, the second lobe having an inner surface shaped to mate with the sealing surface on the second vane, wherein a second drive shaft aperture is formed through the wall of the housing along a second drive shaft axis extending radially from the center of the second vane pivotation axis at an angle to the vane support ring axis to intersect the inner surface of the second lobe, wherein the first drive shaft axis, the second drive shaft axis and the vane support ring tube axis are disposed in a coplanar relation; and wherein an inlet port and an outlet port are formed through the housing center portion along a line perpendicular to the plane of the drive shaft axes and vane support ring tube axis;

a first drive shaft extending through the first drive shaft aperture and attached to the first vane at the center of the first vane pivotation axis for pivotation relative to the first vane about an axis normal to the first vane pivotation axis; and a second drive shaft extending through the second drive shaft aperture and attached to the second vane at the center of the second vane pivotation axis for pivotation relative to the second vane about an axis normal to the second vane pivotation axis.

15. The turbine of claim 14 wherein each of the vanes comprises:

a generally cylindrical core extending axially along the vane pivotation axis of the vane; and two spaced apart, parallel plates extending from one side of the vane core, each plate having an arcuate edge shaped to conform to the lobe inner surface with which the sealing surface on the vane is mated, the arctuate edges of the plates extending from one end of the vane core to the other end thereof; and wherein the drive shaft connected to each of the vanes extends through the space between the plates of the vane and is pivotally connected to the vane core of the vane.

16. The turbine of claim 15 wherein the means for forming a dynamic seal between the two vanes of the turbine comprises a seal shaft extending along a diameter of the vane support ring between the vane pivotation axes and parallel to the vane pivotation axes, the seal shaft having dished surfaces formed in sides thereof facing the vane pivotation axes to mate with portions of the peripheries of the cores of the vanes.

17. The turbine of claim 14 wherein each of the vanes comprises a generally cylindrical core extending axially along the vane pivotation axis of the vane and wherein the means for forming a dynamic seal between the two vanes of the turbine comprises a seal shaft extending along a diameter of the vane support ring between the vane pivotation axes and parallel to the vane pivotation axes, the seal shaft having dished surfaces formed in sides thereof facing the vane pivotation axes to mate with portions of the peripheries of the cores of the vanes.

18. A turbine, comprising:

a vane assembly, comprising:

a tubular vane support ring;

a plate extending across one end of the vane support ring;

a vane mounted on the vane support ring near the other end thereof, the vane supported on the vane support ring for pivotation thereon about a vane pivotation axis extending diametrically across the vane support ring and the vane having a sealing surface, shaped to conform to a portion of a spherical surface centered on the center of the vane pivotation axis, formed thereon to extend between the ends of the vane pivotation axis, wherein two slots are formed through portions of the wall of the vane support ring adjacent said plate, one aperture to either side of a plane defined by the vane pivotation axis and the tube axis of the vane support ring; and means for forming a dynamic seal between the vane and the plate;

a housing enclosing the vane assembly, the housing comprising:

a housing end portion extending about the vane support ring in a concentric relation thereto so as to support the vane assembly for rotation about the axis of the vane support ring;

a lobe attached to the housing end portion at said other end of the vane support ring, said lobe having an inner surface shaped to mate with the sealing surface on the vane, wherein a drive shaft aperture is formed through the wall of the housing along a drive shaft axis extending radially from the center of the vane pivotation axis at an angle to the vane support ring axis to intersect the inner surface of the lobe, and wherein an inlet port and an outlet port are formed through the housing end portion along a line perpendicular to a plane defined by the vane support ring axis and the drive shaft axis; and a drive shaft extending through the drive shaft aperture and attached to the vane at the center of the vane pivotation axis for pivotation relative to the vane about an axis normal to the vane pivotation axis.

19. The turbine of claim 18 wherein the vane comprises a generally cylindrical core extending axially along the vane pivotation axis of the vane and wherein the means formed on the plate for forming a seal between the vane and the plate is characterized as comprising a ridge formed on the plate to extend diametrically across the vane support ring and having a dished side facing the vane pivotation axis to mate with portions of the cylindrical core of the vane.

20. The turbine of claim 19 wherein the vane further comprises two spaced-apart, parallel plates extending from one side of the vane core, each plate having an arcuate edge shaped to conform to the lobe inner surface extending from one end of the vane core to the other end of the vane core; and wherein the drive shaft extends through the space between the plates of the vane and is pivotally connected to the vane core.

21. The turbine of claim 18 wherein the vane comprises:

a generally cylindrical core extending axially along the vane pivotation axis; and two spaced apart, parallel plates extending from one side of the vane core, each plate having an arcuate edge shaped to conform to the lobe inner surface extending from one end of the vane core to the other end thereof; and wherein the drive shaft extends through the space between the plates of the vane and is pivotally connected to the vane core.

* * * * *